US005402207A

United States Patent [19]

Michlin

[11] Patent Number: 5,402,207

[45] Date of Patent: Mar. 28, 1995

[54] LONG-LIFE AND IMPROVED PHOTORECEPTOR DRUM GEAR

[76] Inventor: Steven B. Michlin, 5310 Bentley Suite 105, West Bloomfield, Mich. 48322

[21] Appl. No.: 175,568

[22] Filed: Dec. 30, 1993

[51] Int. Cl.[6] ..... G03G 15/00; G03G 21/00

[52] U.S. Cl. ..... 355/200

[58] Field of Search ..... 355/200, 211, 212, 123

[56] References Cited

U.S. PATENT DOCUMENTS

| | | | |
|---|---|---|---|
| 4,839,690 | 6/1989 | Onoda et al. | 355/211 |
| 4,951,599 | 8/1990 | Damji | 355/200 X |
| 4,975,744 | 12/1990 | Ebata et al. | 355/211 |
| 5,019,861 | 5/1991 | Surti | 355/200 |
| 5,132,728 | 7/1992 | Suzaki et al. | 355/211 X |
| 5,142,322 | 8/1992 | Surti | 355/211 X |

*Primary Examiner*—Fred L. Braun

[57] ABSTRACT

In one embodiment of the invention, the bore in the plastic bushing of a plastic gear attached to a photoreceptor drum in a toner cartridge is enlarged. A metal bushing is inserted within the plastic bushing and allows the gear to rotate around the drum shaft without wearing as quickly. The metal bushing, by pressing against the metal spring-clip contact, ensures the electrical ground connection between the drum and stationary drum shaft. In a second embodiment, the entire gear is manufactured from metal. A conductive joining material, metal prongs, or knurls on the outer surface of the metal bushing contact or scratch into the inner wall of the drum and provide the electrical ground connection between the inner wall of the photoreceptor drum and the drum shaft. On the nonconductive gear side of the drum, the hole in the cartridge wall which receives the gear shaft is lined with a bushing to prevent wear. A gear aligner device which extends into the gear shaft may be alternatively used at this location to align the gear correctly and prevent deforming of the hole in the cartridge wall.

9 Claims, 3 Drawing Sheets

LONG-LIFE AND IMPROVED PHOTORECEPTOR DRUM GEAR

BACKGROUND OF THE INVENTION

This invention relates to solving gear problems on photoreceptor drums as used in Xerography and more specifically in the toner cartridge remanufacturing industry. This includes copiers, laser printers and facsimile machines.

CANON has designed an all-in-one cartridge as seen in U.S. Pat. No. 4,975,744 issued Dec. 4, 1990 assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1993 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, when the photoreceptor drum gets used over and over and over, the mechanical life of the moving parts may be the limiting factor of the length of useful life of the photoreceptor drum. Consequently, it is quite common to see the photoreceptive component of the drum outlive the mechanical components. For example, one problem is that after a large amount of use, say one to three or more recharge cycles, the gears may slightly wear in a way that may not be discernible to the average remanufacturer. The cartridge may appear normal, but have an unobvious problem that is difficult to detect from this wear. This problem has been analyzed in tests involving component switching. It was determined that the photoreceptor drum was the culprit. After closer inspection, it has been found that the problem resulted from the metal drum shaft wearing the plastic hole in the gear, generating an oversized and often oblong hole. It makes sense for a disposable cartridge that is to be used one time to use a plastic wearable component. This will generate the need for brand new cartridges rather than remanufactured ones. Whether the OEM manufacturer is designing these components overseas with such profit motivations is not the point. The disclosed invention has multiple improvements over this state-of-the-art gear set. One of the goals of this invention is to describe a more wear-resistant gear. It should be pointed out that it is rumored in the industry that the gear designs are patented and it is rumored that lawsuits over the design of these plain patented gears are taking place at this moment. So, clearly an alternative gear is needed anyway. One of the wear problems of this OEM gear is that it wears in the center hole and becomes out-of-round. Once it is out-of-round, oblong or otherwise disfigured, it causes an image distortion on the output page. This disfiguration can cause other wear problems in the cartridge and in the printer.

A second photoreceptor drum gear problem involves the grounding contact. The metal drum shaft on one side is electrically connected to the rotating photoreceptor drum to provide a ground to the inside wall of the drum, a necessary design feature. However, with the drum gear rotating with the stationary drum shaft inside, this contact involves a stationary, grounded drum shaft touching a rotating spring-clip contact. This rotating spring-clip contact is contacting the drum shaft tip and rotating with the drum, and often is designed to essentially scratch into the inside wall, usually aluminum, of the drum to insure electrical contact. One problem that occurs is that a thin yet invisible or opaque layer of insulative oxidation, toner dust, or other insulative debris may form a thin coating on the grounding clip or on the tip (contact area) of the drum shaft that prevents or partially may prevent the grounding function from taking place. In other words, the contact surface area is not great, making the typical design more prone to inconsistent grounding. It should be pointed out that in a 360 degree drum rotation, if only a fraction of a degree is insulated and loses contract for ever so brief an interval, each rotation or even every five rotations, this miniscule partial loss of contact can cause very serious image problems. One such problem is erratic print on the output page in places where it is not desired. One solution to the problem has been the use of conductive grease between the spring-contact and drum shaft. However, the conductive grease will typically not last for an entire cartridge cycle although it has been a big help. The conductive greases have two problems. First they won't last a full cycle as stated. Second, some conductive greases harden part way through the cycle and lose their properties. Another problem with the gear design of prior art is that the spring contact clip may lose resiliency or accumulate a thin layer of insulative oxidation or toner and thereby lose its electrical contact in the process. One partial solution is to use emery cloth, sandpaper or other abrasive to file, sand or grind the drum shaft tip or gear's spring-contact to clean it However, there is not a guarantee of perfect contact for an entire cycle since corrosion may occur and toner as well as plastic ground gear-tooth bits may form a thin insulative coating mid-cycle.

There is a second fix to the gear problem. Some photoreceptor drum gears have been designed using a conductive plastic. The conductive plastic gear does not require a spring-contact that touches the drum-shaft's tip. Instead, the conductive plastic gear rotates around the drum shaft and contacts it in the shank over a greater surface area. However, many electrical contact problems have been reported about the use of plastic conductive gears. Loss of continuity takes place. It seems to be from the loss of conductivity after many drum rotations. Perhaps the worn conductive plastic changes state from frictional heat at the contact surface. Perhaps toner insulates it and wears into the plastic, camouflaged. Perhaps the conductive plastic, with metal or graphite particles contained therein, has a wear effect wherein the metal conductive particles migrate away from the contact surface where it contacts the drum shaft. In any case, whatever the reason, plastic conductive gears do not have the desired reliability for drum gears, although it is a clever idea.

Because of the above described problems of photoreceptor drum gears, including the wear problem and the decreasing electrical contact problem in time, this invention has been developed. The invention solves both the wear of the inside gear hole problem as well as the problem of the decrease of electrical contact with time.

There is another gear problem in the industry associated with inserting the drum shaft into the gear and drum. This is a particular problem of the LX gear in the HEWLETT PACKARD LASERJET SERIES IIP. Often times the cartridge recycler, after pushing the smaller diameter drum shaft or shaft into the gear bushing and drum, thereby locking in the gear, gets an unwanted strange dark page of output. This is the result of pushing the drum shaft too far through the gear bushing. The end of the drum shaft is pushed past the drum gear's spring-clip contact, eliminating or weakening the electrical connection and causing the grounding function not to occur. This is a very common problem in the recycling industry, but many recyclers or remanufacturers don't know that the above solution is to avoid pushing in the drum shaft too far. Another solution involves loosening the two screws that hold in the gear bushing that locks in the drum shaft. However, this problem is prevented by using the various gear modifications of this invention, since greater, alternative grounding contact is achieved.

There is yet another gear problem in the toner cartridge industry. This problem is most clearly seen in the HP LASERJET SERIES 4 cartridge of the EX printer engine type. The wear resistant plastic, nylon or TEFLON gear has a shaft protrusion that was cast into the gear. This gear shaft has a small centered hole. This gear shaft fits into a hole in the waste toner hopper assembly. This hole tightly holds the gear shaft to allow it to freely rotate straight and true. Furthermore, the hole has a hollow cylindrical nipple or raised rim reinforcement. The problem lies in the fact that the hole and its reinforcement each are made of a black ABS type plastic. Since the ABS type plastic in the waste toner hopper assembly is much softer than the wear resistant nylon or TEFLON like material, it begins to wear. It is commonly known in the cartridge recycling industry that the gear shaft wears a larger hole in the waste hopper assembly hole, often oblong in shape, in the location where the gear shaft turns. Once this hole enlarges, however, the toner cartridge is useless and unusable, because the untrue rotation has such a detrimental effect on the quality of the image and function of the toner cartridge. Typically, the EX toner cartridge, according to data, can be recycled three times maximum, because this oblong wear pattern in the waste hopper assembly is the limiting factor. It is because of this described problem that another embodiment of the invention has been developed.

Other toner cartridges, such as the ones described previously, oftentimes have a nonconductive gear with a protrusion similar to this gear shaft that rotates inside a reinforced hole of ABS plastic. However, the wear in the ABS plastic was not as noticable as in the EX toner cartridge described above. First of all, rather than using a gear shaft, a cylindrical reinforced hollow rim is molded in the gear. This rim, of greater diameter that the gear shaft described above, acts like a rotating alignment bushing inside the cartridge toner hopper. The rim rotates inside a hole in the ABS type plastic. However, unlike the EX cartridge, this gear rim (as for example in the SX toner hopper assembly) has much less wear. But it eventually does wear. The problem with all of these gears may be solved in a similar manner.

SUMMARY OF THE INVENTION

Accordingly, it is an object of this invention to provide a photoreceptor drum gear with a metal bushing to extend the life of the gear and improve the electrical grounding connection between the inner wall of the drum and the photoreceptor drum shaft.

Another object of this invention is to provide a metal gear that eliminates the need for a spring-clip contact to perform the grounding function.

A further object of this invention is to provide a metal gear with a metal bushing having improvements which, along with serving an electrical grounding function, strengthen the connection between the gear and photoreceptor drum.

A still further object of the invention is to prevent wear or deformity of the hole in the cartridge wall which receives the gear shaft on the generally nonconductive gear side of the photoreceptor drum from adversely affecting the rotation of the drum.

Yet another object of the invention is to provide a device which keeps the gear shaft of the gear on the generally nonconductive gear side of the photoreceptor drum in alignment and thereby prevents reduction in image quality.

In carrying out this invention in the illustration embodiment thereof, a bushing replaces the plastic hole of the photoreceptor drum gear. The hole must be enlarged. The bushing may be plastic or metal. The metal bushing does not wear as quickly, and the metal bushing, by more directly contacting the drum shaft, more effectively grounds the photoreceptor drum. The gear may be made completely of metal thus eliminating the need for the bushing. However a bushing may be replaced when worn. On the outer surface of the bushing in the metal gear, prongs or knurls are used to scratch and grip into the inner wall of the drum, strengthening the connection between the gear and the drum and ensuring metal contact for the drum grounding function.

The invention includes modifications to the cartridge at the generally nonconductive gear side of the photoreceptor drum. In one instance, a bushing is used to line the hole in the waste hopper assembly wall which receives the gear shaft. The bushing prevents the hole from becoming deformed and causing the drum to rotate unevenly, or fixes an already misshapen hole. Or a gear alignment device is used to keep the gear shaft in alignment and thereby keep the drum rotation true. The hollow gear shaft receives one end of the alignment device and the other end of the device is stably supported in the hole through the wall and raised rim of the waste hopper assembly.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
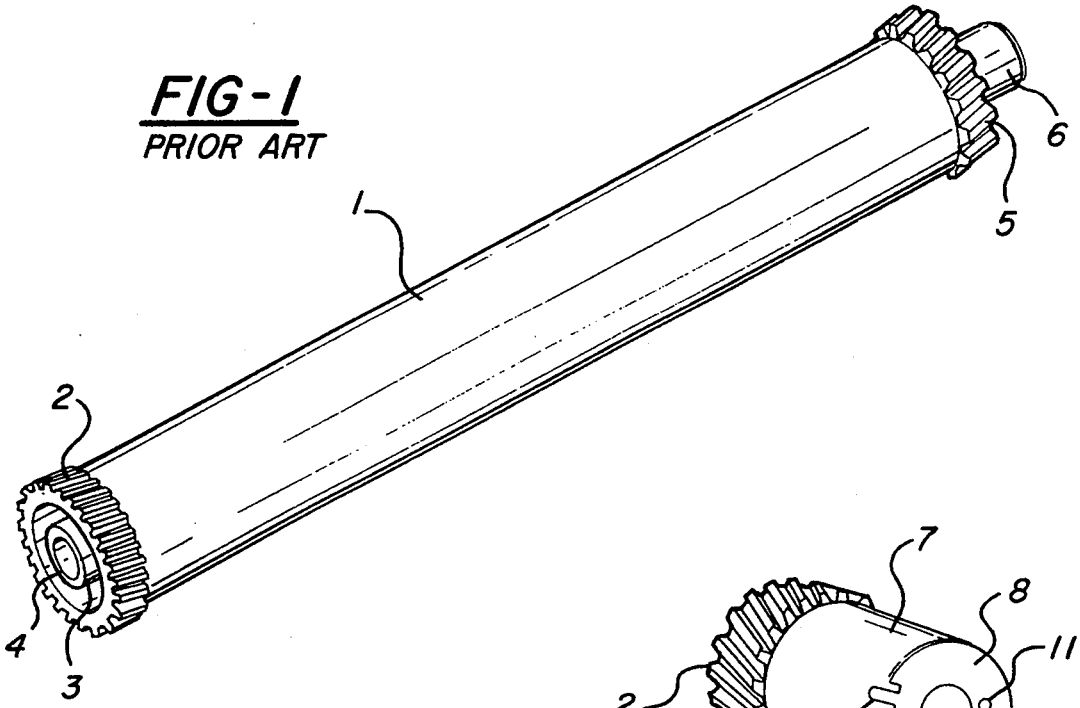
FIG-1 PRIOR ART
FIG. 1 shows a conventional photoreceptor drum with a gear attached at each end.

FIG. 1 shows a conventional photoreceptor drum 1. A plastic gear 2 is received in the end of the drum 1. The gear 2 has an inner cylindrical bushing 3 with a bore 4 sized to fit around the photoreceptor drum shaft (not shown). A gear 5 on the other end of the drum 1 has wider teeth and a cylindrical protrusion 6 for being received by the wall of the toner cartridge assembly. A gear in the printer, copier or facsimile machine meshes with the gear 5 to turn the drum 1. The gear 2 rotates with the drum 1 and is used to turn other components in the cartridge assembly (such as the toner agitator in the hopper) through the use of other gears. The drum 1 and gears 2 and 5 are part of the toner cartridge assembly.

Figure 2:
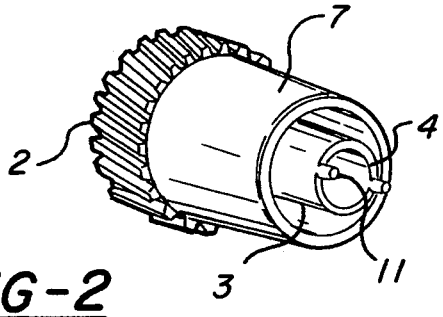
FIG-2 PRIOR ART
FIG. 2 more fully illustrates the conventional plastic gear.
Figure 3:
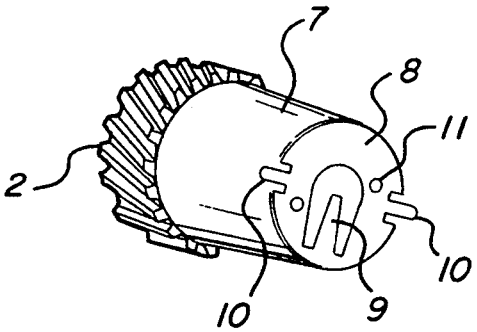
FIG-3 PRIOR ART
FIG. 3 shows a prior art spring-clip contact attached to the photoreceptor drum gear.

The conventional plastic gear 2 is more completely shown in FIG. 2. The photoreceptor drum 1 is basically hollow and at one end and receives the sleeve 7 of the gear 2. The surface of the sleeve 7 is attached to the inner wall of the drum 1 by glue or other known adhesives such that when the gear 5 is driven, the gear 2 rotates with the drum 1. The bushing 3 extends for the length of the gear 2 and its sleeve 7. FIG. 3 shows the same gear 2 with a conventional spring-clip contact 8 attached. The spring-clip contact 8 is metal and has a prong 9 for contacting the stationary drum shaft and prongs 10 for contacting and scratching into the inner wall of the drum 1. The spring-clip contact 8 is attached to the bushing 3 through the use of nubs 11 extending from the bushing 3. The spring-clip contact 8 rotates with the: gear 2 and drum 1. Its function is to electrically ground the photoreceptor drum 1 by connecting the drum 1 with the grounded stationary drum shaft extending through the bushing 3. This allows electrical charge to be conducted away from the photoreceptor drum 1 areas saturated by light during the imaging process, ensuring the quality of the image on the output paper.

There are two main problems with this design, at least in the view of toner cartridge remanufacturers who refill empty toner cartridges with toner and recondition the cartridges so they may be used again. One problem is that the bore 4 in the cast bushing 3 of the gear 2 wears, generating an oversized and often oblong bore. The photoreceptor drum 1 will then wobble or at least not rotate as smoothly, causing image distortion on the output page and other wear problems in the cartridge and printer (for example). The second problem is that often a thin layer of insulative oxidation, toner dust, or other insulative debris forms on the phororeceptor drum shaft or prong 9 of the spring-clip contact 8, preventing the grounding function from taking place. The spring-clip contact 8 may also lose its resiliency with time and thereby lose electrical contact through the prong 9 and drum shaft. The gear 5 experiences the same types of problems.

Figure 4:
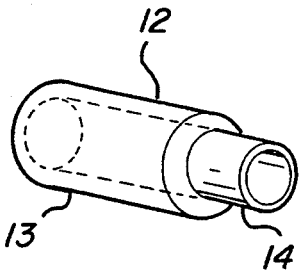
FIG. 4 illustrates the first embodiment of this invention in which a metal bushing having different outside diameters is provided for the gear.

FIG. 4 illustrates a first embodiment of this invention. The invention is described in terms of the gear 2, but it should be noted that the improvements of each embodiment of the invention may also be applied to the gear 5 at the other end of the photoreceptor drum 1. It should also be noted that the gear 5 may be the gear which includes the spring-clip contact 8. In the first embodiment the existing prior art gear 2 is upgraded by enlarging the bore 4 in the bushing 3 and inserting a semi-permanent or replaceable cylindrical metal bushing 12 into the wider bore. The bushing 12 is sized to fit around the photoreceptor drum shaft and rotates with the bushing 3. The metal bushing 12 separates the plastic bushing 3 from the stationary shaft. The metal bushing 12 gives the conventional gear 2 a longer life. The metal bushing 12 is attached to the inner wall of the plastic bushing 3 by glue or other adhesive, but not permanently attached. When the metal bushing 12 wears, it may be removed and replaced with a new bushing. The gear 2 may now last longer than the photoreceptor drum, almost indefinitely since the metal bushing 12 may be replaced anytime it becomes worn. The life of the gear 2 is only limited by the life or wear of the gear teeth, no longer by the life of the plastic bushing 3. The bushing 12, may be also made of conductive plastic (and insulative plastic on the non-grounding gear), designed to be replaceable or modular.

In FIG. 4, the metal bushing 12 is shown as having a larger outer diameter portion 13 for most of its length and a smaller outer diameter portion 14 for the remainder of its length. The reasons for this are the nubs 11. When enlarging the bore 4 in the gear bushing 3, care must be taken so the nubs 11 are not drilled away. If this happens, the spring-clip contact 8 will fall off the bushing 3. So the bore 4 at the end of the bushing 3 with the nubs 11 is not enlarged as much. But the wider portion 13 of the metal bushing 12 allows extra strength and wear life.

Figure 6:
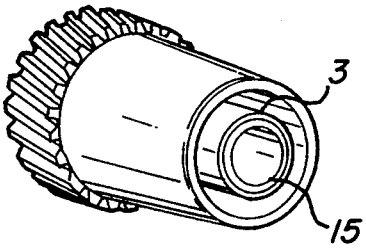
FIG. 6 illustrates the metal bushing inserted in the gear.
Figure 5:
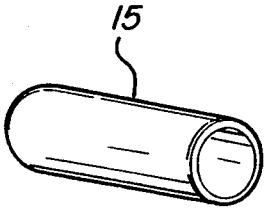
FIG. 5 shows a metal bushing with a uniform outside diameter for use with various types of gears.

FIG. 5 shows a metal bushing 15 uniform in diameter. This is for gear bushings 3 where the spring-clip contact 8 is held on in ways other than the nubs 11, or where the nubs 11 are in a position not affected by enlarging the bore 4. The metal bushing 15 could also be for use in the gear 5. FIG. 6 is an illustration of the metal bushing 15 inserted in the bushing 3 of a gear.

Aluminum, stainless steel, or other steel alloys would be good selections for the material from which the metal bushing 12 and 15 are made. It is important that the metal bushings 12 and 15 have good electrical conductivity, since the metal bushings are designed to press against the spring-clip contact 8 when the contact 8 is attached on the end of the sleeve 7 of the gear 2. In this way, when the prong 9 of the spring-clip contact 8 loses good electrical contact with the drum shaft, the drum 1 is still well grounded through the connection between the drum shaft, metal bushing 12 or 15, spring-clip contact 8, prongs 10 and the inner wall of the photoreceptor drum 1.

Figure 7:
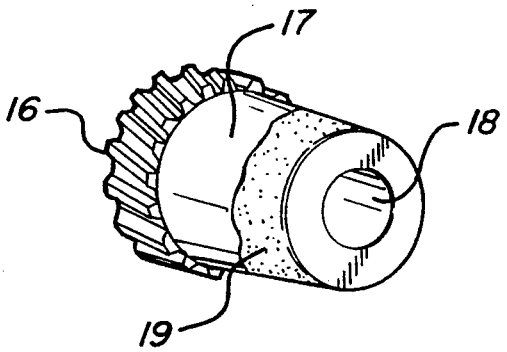
FIG. 7 shows a second embodiment of this invention comprising an all-metal gear.

FIG. 7 shows a second embodiment of this invention. The all-metal gear 16 is manufactured with the metal bushing 17 cast in. The outer surface of the bushing 17 acts as a sleeve for fitting within the inner wall of the photoreceptor drum 1. A bore 18 through the bushing 17 is sized such that the gear 16 rotates smoothly around the photoreceptor drum shaft. Having the metal gear and its bushing manufactured from aluminum would give the gear better conductivity, but it would wear quicker than steel. Having the metal gear 16 and bushing 17 made from stainless steel would give them good corrosion resistance, and other steel alloys with higher electrical conductivity would also be good engineering selections. Because, in this embodiment, there is no need for the spring-clip contact 8. The bushing 17 grounds the photoreceptor drum 1 to the axle or shaft since it is completely metal. A conductive joining material 19, such as a liquid glue with fine aluminum or copper particles suspended in the glue, would be used to secure the bushing 17 to the inner wall of the drum 1.

Applicant is not aware of an all-metal gear ever having been used on a photoreceptor drum. The logic in the prior art has been that one wants the photoreceptor drum gear in the all-in-one toner cartridge to wear quicker than the printer or copy machine gear that drives the photoreceptor drum gear. The concept of the toner cartridge is that few printer or copier components need routine replacement since the moving parts that wear are in the cartridge. However, if the printer and copier manufacturers made the printer gear into an easily replaceable metal modular gear, then the photoreceptor drum gears could be made of metals without fear of damaging or quickly wearing the printer or copier gear. An aluminum printer gear (for example) would work fine. Such gears could be inexpensively manufactured by casting. A customer-installable-and-removable metal gear for the printer could be provided with this invention to allow more efficient use of the metal photoreceptor drum gear 16.

Figure 8:
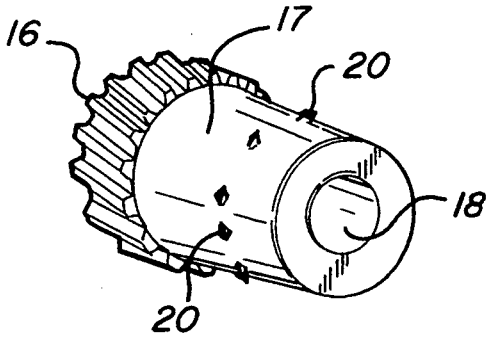
FIG. 8 illustrates a modification of the all-metal gear so it includes prongs to help electrically ground the drum.

FIG. 8 illustrates an alternative to the conductive joining material 19. Little prongs 20 could be added to the outer surface of the bushing 17 in the casting process to scratch into the inner wall of the drum 1, ensuring electrical contact for the grounding function. The prongs 20 could be in the shape of little pyramids for good strength and so the tip and corners of each pyramid cut into the inner wall of the drum 1.

Figure 9:
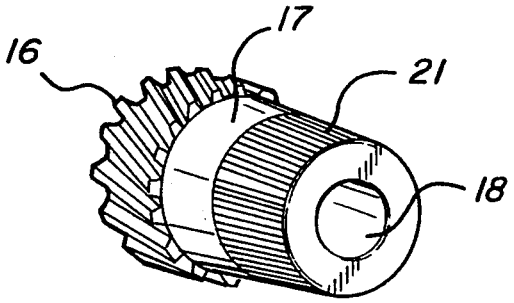
FIG. 9 shows a modification which uses knurls parallel to the axis of the gear as an alternative to prongs.
Figure 10:
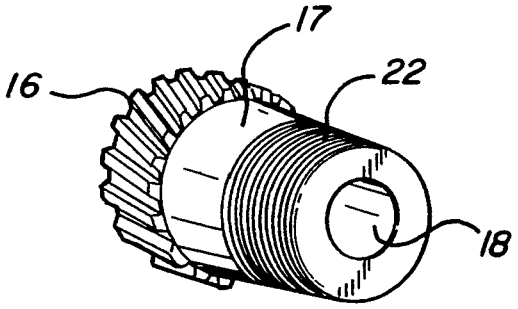
FIG. 10 illustrates a gear with knurls extending around the circumference of the bushing.
Figure 11:
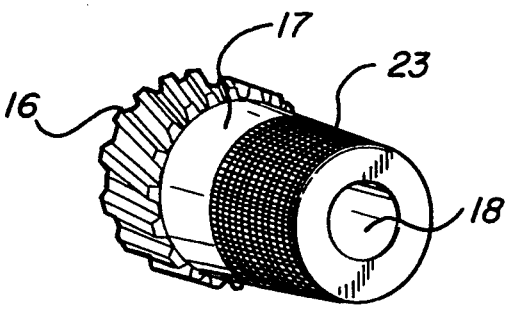
FIG. 11 shows a gear having double knurls on the bushing for improved grounding contact.

FIGS. 9–11 illustrate more alternatives to the conductive joining material 19 and prongs 20. A portion of the outer surface of the bushing 17 is knurled. The roughness or ridges of the knurls would cut into the inner wall of the drum 1, providing the electrical connection needed to ground the drum. Care must be taken so the glue or adhesive which secures the bushing 17 to the inner wall of the drum 1, if insulative glue or adhesive is used, does not cover the knurls and insulate the contact to prevent grounding. The knurls would not only help make electrical contact, but could help the gear 16 grip the inner wall of the drum 1. FIG. 9 and 10 show single knurls. The knurls 21 shown in FIG. 9 are parallel to the rotational axis of the gear 11. The knurls 22 shown in FIG. 10 each extend around the circumference of the bushing 17. The parallel knurls 21 grip the inner wall of the drum 1 best, reducing slippage. The double knurl 23 shown in FIG. 11, with the knurls perpendicular or at some other angle to each other, also works very well. Any type of knurl would help the gear 16 grip the inner wall of the drum 1 and ensure the soundness of the electrical connection for grounding the drum.

Additionally, a separate metal bushing could also be used within the bushing 17 of the all-metal gear 16. Since the bushing would be replaceable, life of the metal gear would be extended.

Figure 12:
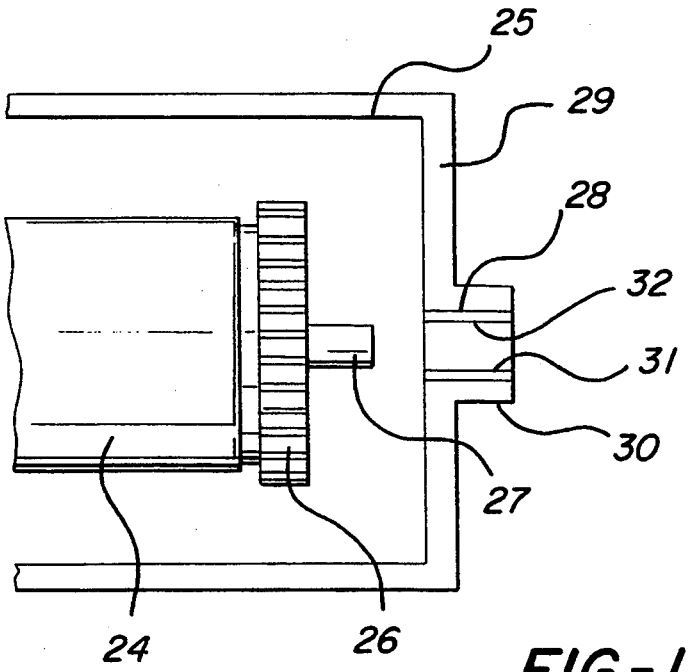
FIG. 12 shows the third embodiment of the invention, which comprises a bushing inserted in the cartridge wall for receiving the gear shaft.
Figure 13:
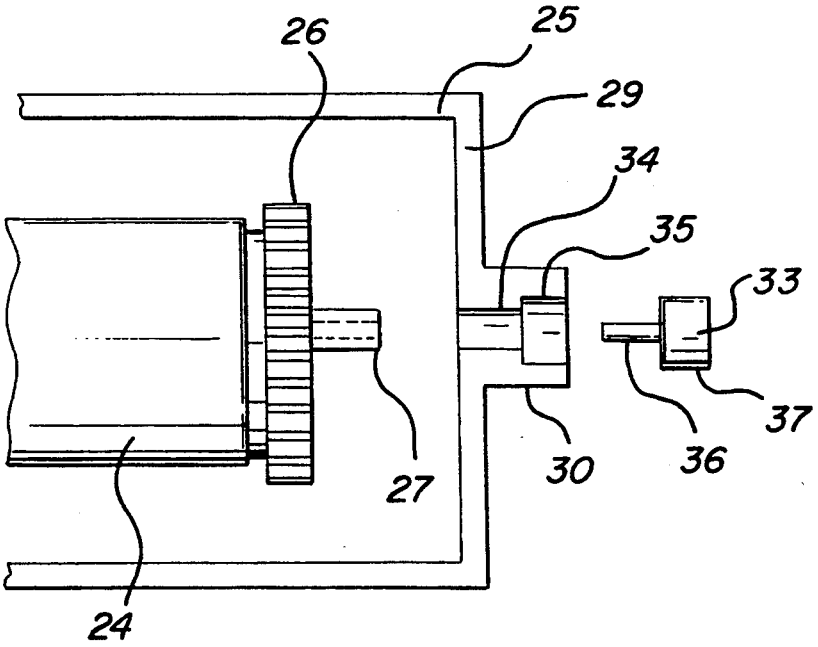
FIG. 13 illustrates a fourth embodiment consisting of a gear aligner device for keeping the rotation of the drum true.

FIG. 12 shows a third embodiment of this invention. The wear problems in the HEWLETT PACKARD SERIES 4 or EX toner cartridge involve the usually nonconductive gear side of the photoreceptor drum 24. Only a cross-sectional view of the waste hopper assembly 25 is shown. The plastic gear 26 is attached to the drum 24 and turned by a gear in the printer, copier, or facsimile machine. The gear 26 has a hollow plastic gear shaft 27 which fits into a hole 28 in the wall 29 of the waste hopper assembly 25° When the drum 24 rotates, the gear shaft 27 rotates in the hole 28. The hole 28 extends through a raised cylindrical rim 30 on the opposite side of the waste hopper assembly wall 29. The rim 30 helps support the gear shaft 26. With this invention, the hole 28 through the assembly wall 29 and rim 30 has been enlarged by drilling or other method and lined with a metal, plastic, nylon or TEFLON bushing 31 replaceably secured in the hole 28. The bushing 31 prevents the hole 28 from wearing and becoming oblong or oversized. So the drum 24 does not wobble or otherwise rotate unevenly and the quality of the image is maintained. When the inside diameter 32 of the bushing 31 begins to wear, the bushing 31, unlike the wall 29 of the waste hopper assembly 25, can be easily replaced. The bushing 31 may be used to repair a waste hopper assembly that already has an oblong hole as well as for preventing such wearing. Please note that the hole 28 in FIG. 12 has been drilled and reamed in this case to modify the EX waste toner 25 hopper to prepare it for the bushing 31. Originally, before drilling, the waste hopper is as seen in FIG. 13 where the hole has two different diameters at 34 and 35. However, the hole is drilled out. The main reason the invention is necessary is because the hole 34 gets worn out and disfigured, often oblong, by the rotating shaft 27, because the ABS plastic of the. waste hopper 25 is not wear resistant like the plastic of the gear 26. In many cases, the majority of the hole 34 is worn, where it contacts the shaft, however, a small portion where hole 34 joins hole 35 and in the vicinity, the hole is not as deformed or not deformed at all.

The fourth embodiment of this invention uses the gear aligner device 33 shown in FIG. 13 to keep the rotation of the photoreceptor drum 24 straight and true. The gear shaft 27 is hollow and does not extend through the full, length of the raised cylindrical rim 30 when inserted in the hole 28. The hole 28 in some toner waste hopper assemblies, such as in the EX cartridge, has two different sizes. In the first part 34 of the hole 28, the hole is sized to receive the gear shaft 27. The second part 35 or remainder of the hole 28 is slightly larger in diameter. The gear aligner device 33 has two portions. The first portion 36 of the gear aligner device 33 is sized to fit inside the hollow gear shaft.27. The second portion 37 of the gear aligner device 33 is sized to snugly fit within the second, larger diameter part 35 of the hole 28, since the gear aligner device 33 is inserted through the hole 28 into the drum gear shaft 27 from the rim 30 side of the waste hopper assembly wall 29. This aligns the gear 26 properly, allowing true rotation of the drum 24, and moves the wear problem to the hollow gear shaft 27 of the easily replaceable wear-resistant gear 26. In cases where the hole 28 has two different diameters 34 and 35, the shaft 27 may not fill the entire hole 34 for the hole 34's full length or the drum 24 may have some play along its longitudinal axis. For this reason, the gear alignor device 33 may optionally have two different diameters 37, some that is correct diameter to fit the hole 35 and some of correct diameter to fill the hole 34, to achieve better alignment and also minimize play along the drum 24's longitudinal axis. Aligning the drum 24 and preventing the longitudinal sway thus helps prevent the drum 24 from wearing as quickly as otherwise. Optionally, the gear alignor device 33 may be glued in place to secure it in the hole 35. The gear aligner device 33, as well as the bushing 31, may be molded and works best when made of metal, such as aluminum for example, but may also be made from plastic with a high wear resistance, such as nylon, or TEFLON.

Since minor changes and modifications varied to fit particular operating requirements and environments will be understood by those skilled in the art, the invention is not considered limited to the specific examples chosen-for purposes of illustration, and includes all changes and modifications which do not constitute a departure from the true spirit and scope of this invention as claimed in the following claims and reasonable equivalents to the claimed elements.

What is claimed is:

1. In a plastic gear for a photoreceptor drum used in toner cartridges for printers, copiers and facsimile machines, said plastic gear being attached to said drum and including a plastic bushing with a bore for receiving a drum shaft around which said plastic gear and said drum rotate, said plastic gear also including a metal spring-clip contact which provides an electrical ground connection between said drum and said drum shaft, an improvement comprising a replaceable metal bushing inserted in said bore of said plastic bushing and pressing against said metal spring-clip contact, whereby wear of said plastic bushing is reduced, the life of said plastic gear is extended, and said electrical ground connection is ensured regardless of wear of said metal spring-clip contact.

2. A plastic gear as in claim 1 wherein said metal bushing is a highly electrically conductive steel alloy.

3. A plastic gear as in claim 1 wherein said metal bushing has first and second portions, said second portion having a smaller outer diameter than said first portion, said second portion of said metal bushing pressing against said metal spring-clip contact.

4. In a gear for a photoreceptor drum used in toner cartridges for printers, copiers and facsimile machines, said gear bring attached to said drum and including a bushing with a bore for receiving a drum shaft around which said gear and said drum rotate said bushing of said gear having an outer surface and said drum having an inner wall, said outer surface contacting said inner wall when said gear is attached to said drum, an improvement comprising having said gear including said bushing completely made from metal with conductive joining material on said outer surface of said bushing of said gear for helping to attach said gear to said drum and for providing an electrical ground connection between said drum and said drum shaft, wherein said conductive joining material is glue including a suspension of metal particles.

5. A gear as in claim 4 wherein said metal of which said gear including said bushing is made is a highly electrically conductive steel alloy.

6. In a gear for a photoreceptor drum used in toner cartridges for printers, copiers and facsimile machines, said gear being art ached to said drum and including a bushing with a bore for receiving a drum shaft around which said gear and said drum rotate, said bushing of said gear having an outer surface and said drum having an inner wall, said outer surface contacting said inner wall when said gear is attached to said drum, an improvement comprising having said gear including said bushing completely made from metal with means on said outer surface of said bushing of said gear for helping to attach said gear to said drum and for providing an electrical ground connection between said drum and said drum shaft, said means comprising knurls on said outer surface for scratching into said inner wall, said gear having a rotational axis and said bushing having a circumference, some of said knurls being parallel to said rotational axis and some of said knurls extending around said circumference, whereby a double knurl is formed.

7. A gear aligner device for a toner waste hopper assembly, said assembly including a wall with a raised cylindrical rim on one side and a hole extending through said wall and said rim, said hole having two parts of different diameter, a first part sized to receive a hollow gear shaft of a gear attached to a photoreceptor drum and a second, larger diameter part through said rim, said gear aligner device comprising a first portion sized to fit within said hollow gear shaft in said first part of said hole and a second portion sized to fit snugly within said second part of said hole.

8. A gear aligner device as in claim 7 wherein said gear aligner device is metal.

9. A gear aligner device as in claim 7 wherein said gear aligner device is made of a plastic with high wear resistance.

* * * * *